United States Patent [19]

Klitsner

[11] Patent Number: 5,007,876

[45] Date of Patent: Apr. 16, 1991

[54] BANKED HAIRPIN MARBLE RACE TOY

[75] Inventor: Daniel B. Klitsner, San Francisco, Calif.

[73] Assignee: Discovery Toys, Inc., Martinez, Calif.

[21] Appl. No.: 214,243

[22] Filed: Jul. 1, 1988

[51] Int. Cl.[5] ..... A63H 29/08; A63F 9/14

[52] U.S. Cl. ..... 446/168; 273/86 C; D21/143

[58] Field of Search ..... 446/168, 169, 170, 171, 446/172, 173, 89, 117; 273/86 C, 108, 112, 113; D21/143

[56] References Cited

U.S. PATENT DOCUMENTS

| | | | |
|---|---|---|---|
| D. 290,143 | 6/1987 | Wichman | D21/143 |
| D. 290,145 | 6/1987 | Wichman | D21/143 |
| D. 294,044 | 2/1988 | Wichman | D21/143 |
| 1,449,565 | 3/1923 | Vogel | 446/169 |
| 1,544,411 | 6/1925 | Kern | 273/112 |
| 2,729,914 | 1/1956 | Cook | 446/168 |
| 2,752,727 | 7/1956 | Cotton | 446/168 |
| 2,838,870 | 6/1958 | Morse | 446/168 |
| 3,379,440 | 4/1968 | Jaffe | 273/86 C |
| 3,946,516 | 3/1976 | Wirth | 446/117 |
| 4,037,355 | 7/1977 | Street | 446/173 |
| 4,713,038 | 12/1987 | Wichman | 446/168 |

FOREIGN PATENT DOCUMENTS

| | | | |
|---|---|---|---|
| 1405105 | 7/1975 | United Kingdom | 446/168 |

OTHER PUBLICATIONS

Berotoys catalog (two pages).

Design Patent Appln. Ser. No. 216,731 for Banked Hairpin Marble Race Toy.

*Primary Examiner*—Robert A. Hafer

*Assistant Examiner*—Michael Brown

*Attorney, Agent, or Firm*—Townsend and Townsend

[57] ABSTRACT

A marble race toy (4) for use with a marble race game (2) of the type in which a marble (6) moves along a tortuous path. The toy alters the path of the marbles rolling through the game along a track (16) and includes a downwardly sloping first portion (10) extending from an entrance (18) and continuous with an upwardly sloping second portion (12). The toy includes a third portion (14) parallel to the second portion. The third portion includes an upper end (28) coupled to the second portion by a U-shaped track portion (34) for generally reversing the direction of the marble, and a lower end (30) which opens into the exit. An escape (36) couples the second and third ends (22, 24) of the first and second track portions to the exit to allow the marble to move through the toy, bypassing the third track portion.

20 Claims, 2 Drawing Sheets

BANKED HAIRPIN MARBLE RACE TOY

BACKGROUND OF THE INVENTION

Marble race games, in which a marble rolls along a tortuous path, have been developed and are enjoyable to watch. Modular constructions allow the user to construct different configurations. Children and adults alike are amused as their eyes follow the marble along the tortuous path which they have constructed.

Marble race games using ramps and tubular connectors are well-known. For example, U.S. Pat. No. 3,946,516 to Wirth discloses a game including only two distinct elements: a connecting tube and a track. The marble drops down the middle of the connecting tube to transfer its movement from one path to another from the top of the course to its bottom. Similarly. U.S. Pat. No. 2,838,870 to Morse discloses identical runways for interengagement of an extended course. The marble travels from the top of the course from one ramp to another until it reaches the bottom.

U.S. Pat. No. 4,713,038 to Wichman et al has been developed by the assignee of the present application and is incorporated by reference. Wichman et al discloses a variety of marble race toys having different configurations for altering the characteristics of travel as the marble passes through each toy, varying the rolling speeds and lengthening the time it takes for each marble to course through the game. Wichman et al includes a number of modular race toys constructed for connection to one another so that a marble passes from the exit of one marble race toy to the entrance of another, downstream marble race toy. All the marble race toys keep the marble moving at a great enough rolling speed to maintain visual interest and yet increase the amount of time it takes to course the entire route of the game. This is done in many of the individual toys of the Wichman et al patent by extending the path along which the marble rolls, or otherwise increasing the time it takes to traverse an entire marble race toy.

Other marble race toys have been created by the present inventor, including those described in applications entitled "Start Gate Marble Race Toy," U.S. patent application Ser. No. 218,279, and "Jump Chute Marble Race Toy," U.S. patent application Ser. No. 214,239, each filed concurrently herewith and assigned to the assignee of the present invention, the disclosures of which are incorporated by reference. U.S. Pat. No. 3,379,440 to Jaffe discloses a marble race game including various curved track sections. Two marbles are placed at the starting area of the marble race game which follow identical mirror-image tracks so that two players can simultaneously race their marbles.

SUMMARY OF THE INVENTION

The present invention is directed to a marble race toy in which the marble moves from the entrance of the toy downwardly along a first arcuate path portion and continues upwardly along a second path portion. The first track portion, defining the first path portion, slopes downwardly from a first end positioned at the entrance toward a second end. The second track portion, defining the second path portion, includes third and fourth ends. The third end slopes upwardly from the second end of the first track portion such that the first and second track portions preferably form a smoothly curving track defining a vertically oriented flat plane. The third track portion, defining the third path portion, includes fifth and sixth ends, the fifth end sloping downwardly from the fourth end of the second track portion and being parallel to the second track portion. The fourth and fifth ends are coupled by a U-shaped track portion defining a U-shaped path portion, which generally reverses the direction of the path of the marble and directs it toward the exit.

The marble may either return back along the second track portion (when it has insufficient speed to pass through the U- shaped track portion) or travel through the U-shaped track portion into the third track portion. Because of the possibility of the former case, an escape path is formed along the first and second track portions to permit the marble moving at insufficient speed to pass directly into the exit: while in the latter case, the marble passes into the exit immediately after traversing the third path portion. In either case, the marble then exits the toy for travel through the remaining toys of the marble race game. For ease of reference, a marble, as herein defined, is considered any object which is capable of rolling along the tortous path of the game and, therefore, could be generally cylindrical or oval as well as spherical.

The marble race toy includes a modular construction for connecting to different toys of the game so that a marble passes from the exit of one marble race toy to the entrance of another, downstream toy. The marbles pass through the toy with a great enough rolling speed to maintain visual interest of the user watching the marbles traverse the varying paths of the marble race game. As the marble travels along the first track portion, the speed increases but then decreases as the marble traverses the second track portion. The marble quickly reverses its direction as it moves from the second track portion to the third track portion. The marble again picks up its speed as it rolls along the third track portion to pass out of the toy at the exit. The first, second. U-shaped and third path portions provide an interesting visual range of speeds and directions of movement.

The marble race toy is preferably connected intermediate the start and finish of the marble race game; however, it is within the scope of the present invention to provide the marble race toy as a starting or finishing toy of the marble race game.

The marble race toy of the present invention provides an interesting course for marbles, allowing increasing and decreasing speeds, a quick reversal of the direction of the marble from the second to the third path portions and travel through the exit so as to follow the tortuous path of the remaining toys of the marble race game. If the marble does not have sufficient momentum to carry it to the top of the second track portion, into the U-shaped track portion and down the third track portion, the present invention provides an escape for the marble to pass into the exit.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
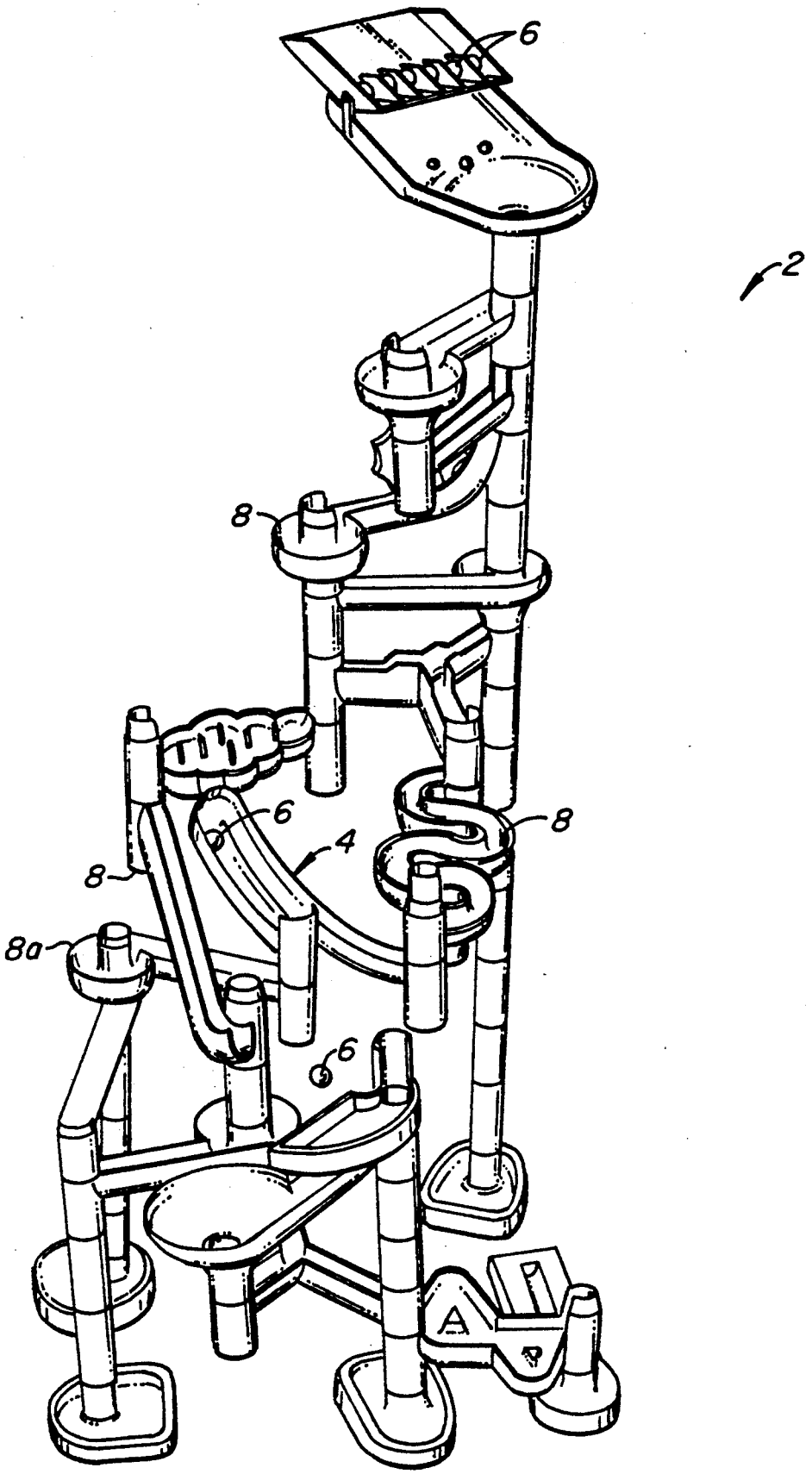
FIG. 1 is an overall perspective view of a marble race game including the marble race toy of the present invention.

Referring now to the drawings, FIG. 1 illustrates the marble race game 2 constructed to include a marble race toy 4 intermediate the ends of the tortuous path along which a marble 6 travels.

The arrangement of the various toys 8 constituting game 2 may be varied from that disclosed in FIG. 1. The toys other than marble race toy 4 are shown for environmental purposes only and do not constitute a part of this invention. They will, therefore, not be described in detail in this application.

Figure 2:
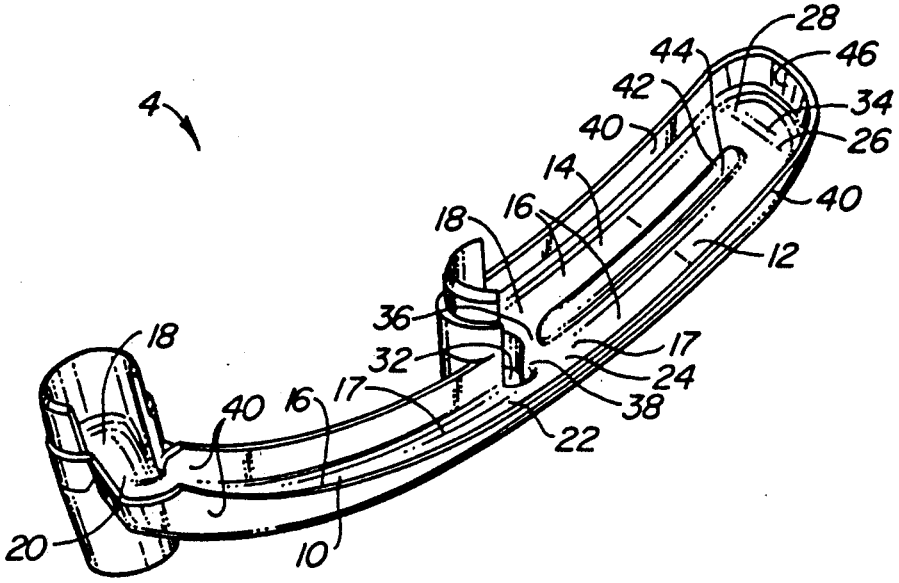
FIG. 2 is a perspective view of the marble race toy of the present invention.
Figure 3:
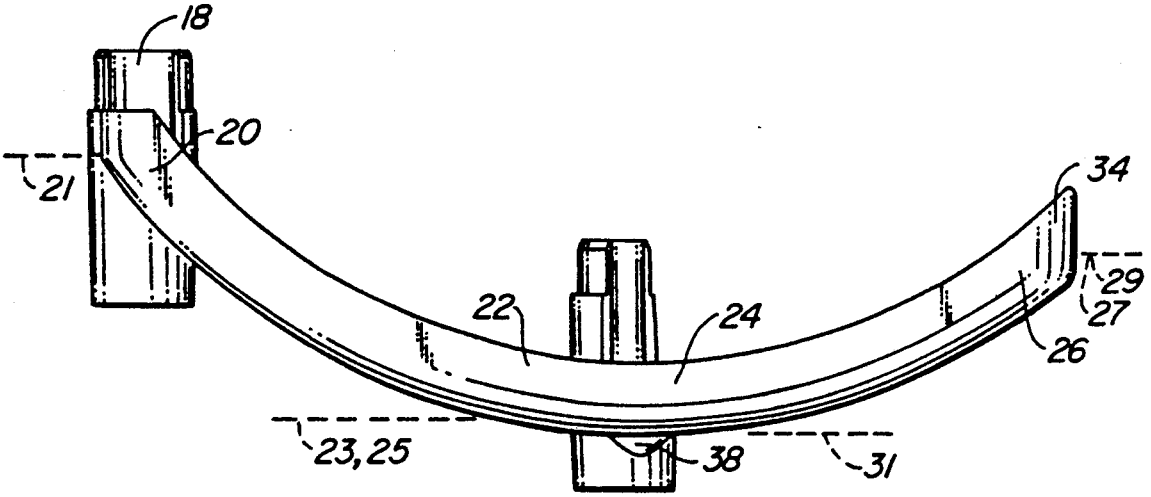
FIG. 3 is a side view of the marble race toy of FIG. 2.

Referring now also to FIGS. 2 and 3, marble race toy 4 includes banked hairpin track 16 including, in order, a first track portion 10, a second track portion 12, a U-shaped track portion 34, and a third track portion 14. Track 16 has a generally U-shaped cross section sized to accommodate rolling marbles 6.

First track portion 10 has a first end 20 adjacent entrance 18 and slopes downwardly from the entrance to a second, lower end 22. Second track portion 12 includes a third, lower end 24 and a fourth, upper end 26. Third end 24 adjoins second end 22 of first track portion 10 to thereby define a smoothly curving arcuate track portion 17 which defines a vertically oriented flat plane.

Second track portion 12 and third track portion 14 are juxtaposed. Third track portion 14 includes a fifth, upper end 28 and a sixth, lower end 30. Third track portion 14 slopes downwardly from fifth end 28 to sixth end 30. An exit 32 is positioned at lower end 30. Marble 6 passes out of toy 4 through exit 32 and into a downstream toy 8, such as toy 8*a* of FIG. 1. Fifth end 28 is coupled to fourth end 26 by U-shaped track portion 34 which generally reverses the direction of travel of the marble.

Each of the first through sixth ends 20, 22, 24, 26, 28, 30 are positioned at first through sixth elevations 21, 23, 25, 27, 29, 31, respectively. See FIG. 3. First elevation 21 is positioned above all the other elevations. Fourth and fifth elevations 27, 29 are positioned above the second, third and sixth elevations 23, 25, 31.

Sidewalls 40, 42 surround first, second and third track portions 10, 12, 14, forming the vertical walls of U-shaped cross-sectional track portion 16. As discussed above, second track portion 12 and third track portion 14 are juxtaposed and parallel to each other. The sidewalls 42 of second and third track portions 12, 14, abut and are integral with each other, forming a barrier 44 separating second and third track portions 12, 14.

U-shaped track portion 34 includes banked sidewall 46 intersecting bottom surface 35 at an obtuse angle, see FIG. 3, and causes marble 6 to quickly reverse its direction as it moves from second track portion 12 to third track portion 14.

Entrance 18 is offset with respect to first end 20 of first track portion 10. Exit 32 is adjacent sixth end 30 and is generally aligned with third track portion 14. Entrance 18, exit 32 and third track portion 14 are all generally aligned in a flat vertical plane.

Second end 22, third end 24 and sixth end 30 are located at approximately the same elevation. An escape 36 couples first and second track portions 10, 12 with exit 32. Escape 36 includes a depression 38 formed at the intersection of second end 22 and third end 24 of first and second track portions 10, 12 which guides marble 6 toward exit 32. Depression 38 is slightly elongated and formed at an angle along the bottom surface of second track portion 12.

Escape 36 is preferably located at the low point of first and second track portions 10, 12 and adjacent exit 32. However, exit 32 could be spaced apart from the exit 32 which would require escape 36 to provide an extended path to exit 32 or require toy 4 to include more than one exit 32. As discussed below, a marble 6 exits through escape 36 when it has insufficient momentum to carry it through second portion 12, U-shaped track 34 and into third portion 14.

In use, marble 6 rolls through various toys 8 of marble race game 2. Marble 6 enters marble race toy 4 through entrance 18 of track 16. Marble 6 increases its speed as it rolls downwardly along first track portion 10 toward second end 22. The momentum of marble 6 allows continued travel upwardly along second track portion 12 toward fourth end 26. As marble 6 travels upwardly, its velocity gradually decreases as it approaches fourth end 26. If marble 6 maintains a sufficient velocity, it will continue through U-shaped track portion 34, quickly reversing its direction as it moves along banked sidewall 46. From U-shaped track 34, the marble travels into third track portion 14 and out of marble race toy 4 through exit 32 to remaining toys 8. If the marble has insufficient velocity, it will return downwardly along second track portion 12 with increasing velocity. Marble 6 will move in an oscillatory motion back and forth along first and second track portions 10 and 12. Once its speed slows sufficiently, it will pass into depression 38, through escape 36 and then through exit 32.

Modification and variation can be made to the disclosed embodiment without departing from the subject of the invention as defined by the following claims.

I claim:

1. A marble race toy for use with a marble race game of the type in which a marble moves along a tortuous path comprising:

a marble track having an entrance and an exit;

the track including a first portion, having first and second ends, sloping downwardly from the entrance, a second portion, having third and fourth ends, sloping upwardly from the second end, a third portion, having fifth and sixth ends, sloping downwardly from the fourth end, and a U-shaped track portion, coupling the fourth and fifth ends, which generally reverses the direction of the marble;

the first end being adjacent the entrance;

the sixth end being adjacent the exit;

the first and second portions forming a smoothly curving track portion together defining a vertically oriented flat plane;

the second and third portions being juxtaposed, generally parallel to one another, and having a common wall therebetween dividing the second and third portions;

the first, second, third, fourth, fifth and sixth ends being at first through sixth elevations, the first elevation being above the fourth and fifth elevations which are above the second, third and sixth elevations.

2. The toy as defined in claim 1 wherein the U-shaped track portion includes a U-turn reversing the direction of the marble toward the first portion.

3. The toy as defined in claim 1 wherein the first portion, the second portion and the third portion each comprise an arcuate path.

4. The toy as defined in claim 1 wherein the entrance is offset with respect to the first portion.

5. The toy as defined in claim 1 wherein the exit is generally aligned with the third portion.

6. A marble race toy for use with a marble race game of the type in which a marble moves along a tortuous path comprising:

a marble track having an entrance and an exit;

the track including a first portion, having first and second ends, sloping downwardly from the entrance, a second portion, having third and fourth ends, sloping upwardly from the second end, a third portion, having fifth and sixth ends, sloping downwardly from the fourth end, and a U-shaped track portion, coupling the fourth and fifth ends, which generally reverses the direction of the marble;

the first end being adjacent the entrance;

the sixth end being adjacent the exit;

the first and second portions forming a smoothly curving track portion;

the second and third portions being generally parallel to one another; and an escape means for allowing the marble to move through the toy from a chosen one of the first and second portions to the exit, bypassing the third portion.

7. The toy as defined in claim 6 wherein the smoothly curving track portion defines a vertically oriented flat plane.

8. The toy as defined in claim 6 wherein the first, second, third, fourth, fifth and sixth ends are positioned at first through sixth elevations, the first elevation being above the fourth and fifth elevations which are above the second, third and sixth elevations.

9. The toy as defined in claim 6 wherein said first portion and said second portion are coplanar.

10. A marble race toy for use with a marble race game of the type in which a marble moves along a tortuous path comprising:

a marble track having an entrance and an exit;

the track including a first portion, having first and second ends, sloping downwardly from the entrance, a second portion, having third and fourth ends, sloping upwardly from the second end, a third portion, having fifth and sixth ends, sloping downwardly from the fourth end, and a U-shaped track portion, coupling the fourth and fifth ends, which generally reverses the direction of the marble;

the first end being adjacent the entrance;

the sixth end being adjacent the exit;

the first and second portions forming a smoothly curving track portion;

the second and third portions being generally parallel to one another;

the first, second, third, fourth, fifth and sixth ends being at first through sixth elevations, the first elevation being above the fourth and fifth elevations which are above the second, third and sixth elevations; and an escape means for allowing the marble to exit from a chosen one of the first and second portions to continue its tortuous path through the marble race game.

11. A toy for use with a marble race game of the type in which a marble moves from an entrance to an exit along a tortuous path comprising:

a first track portion including a first end, coupled to the entrance, and a second end, spaced from the first end;

a second track portion continuous with the second end of the first track portion and including a third end adjoining the second end of the first track portion and a fourth end spaced from the third end;

a third track portion having a fifth end coupled to the fourth end and a sixth end coupled to the exit, the exit being proximate the second end of the first track portion; and an escape, said escape coupling at least one of the first and second track portions to the exit to allow the marble to move through the toy, bypassing at least the third track portion.

12. The toy as defined in claim 11 wherein the first track portion and the second track portion form a vertical plane and wherein the third track portion and the second track portion are juxtaposed.

13. The toy as defined in claim 11 wherein the first track portion and the third track portions include means for imparting an increasing speed to the marble and wherein the second track portion includes means for imparting a decreasing speed to the marble.

14. The toy as defined in claim 11 further comprising means for guiding the marble toward the escape, the means for guiding the marble being positioned adjacent the second end of the first track portion.

15. The toy as defined in claim 14 wherein the first track portion and the second track portion form an intersection at the second and third ends and wherein the means for guiding the marble comprises a depression formed at the intersection.

16. The toy as defined in claim 11 wherein the first, second, third, fourth, fifth and sixth ends are at first through sixth elevations, the first elevation being above the fourth and fifth elevations which are above the second, third and sixth elevations.

17. A toy for use with a marble race game of the type in which a marble moves along a tortuous path from an entrance to an exit comprising:

a first, substantially planar, downwardly sloping track portion having an upper end adjacent the entrance, and a lower end;

a second, substantially planar, upwardly sloping track portion having a lower end continuous with the lower end of the first track portion and an upper end;

a third track portion in side-by-side relationship with the second track portion and having a common wall therebetween dividing the second and third track portions;

the first track portion and the second track portion being substantially coplanar and comprising a vertically oriented substantially planar arcuate path; and wherein the marble moves from the entrance to the first track portion with an initial speed, the first track portion imparts an increasing speed to the marble and wherein the second track portion imparts a decreasing speed to the marble.

18. The toy as defined in claim 17 wherein the exit is located at the lower ends of the first and second track portions, the lower ends of the first and second track portions connected to said exit.

19. The toy as defined in claim 17 further comprising a third track portion continuous with the upper end of the second track portion and generally parallel thereto.

20. The toy as defined in claim 19 wherein the third track portion is coupled to the exit.

* * * * *